United States Patent [19]

Østergaard

[11] Patent Number: 4,687,138

[45] Date of Patent: Aug. 18, 1987

[54] DEVICE IN OR FOR HIGH-PRESSURE CLEANING UNITS FOR HEATING THE WATER BY CIRCULATION

[75] Inventor: Tage V. Østergaard, Hadsund, Denmark

[73] Assignee: Knud Erik Westergaard, Hadsund, Denmark

[21] Appl. No.: 673,922

[22] Filed: Nov. 21, 1984

[30] Foreign Application Priority Data

Nov. 25, 1983 [DK] Denmark ..... 5389/83

[51] Int. Cl.[4] ..... B05B 9/03

[52] U.S. Cl. ..... 239/126; 239/135

[58] Field of Search ..... 239/124, 126, 128, 135, 239/310, 317, 318, 127

[56] References Cited

U.S. PATENT DOCUMENTS

| | | | |
|---|---|---|---|
| Re. 27,855 | 12/1973 | Norstrud et al. | 239/126 |
| 2,942,787 | 6/1960 | Bok et al. | 239/128 X |
| 3,013,730 | 12/1961 | Bok et al. | 239/135 X |
| 3,246,845 | 4/1966 | Techler et al. | 239/126 X |
| 3,383,044 | 5/1968 | Norstrud et al. | 239/126 |
| 4,182,354 | 1/1980 | Bergstedt | 239/126 X |

*Primary Examiner*—Andres Kashnikow
*Assistant Examiner*—Daniel R. Edelbrock
*Attorney, Agent, or Firm*—Felfe & Lynch

[57] ABSTRACT

In high-pressure cleaning units with heating stages, i.e. with a possibility for circulating a partial flow of the forwardly pumped water through a constricted, heat-generating nozzle (74) in a return conduit to the pump's inlet side, the problem occurs that the entire water flow circulates at high pump pressure upon temporary interruption of ejection, which causes an inexpediently high heating of the water. By the invention, apparatus is provided for sensing this situation and thus block the return conduit (70,72), so that the pressure tends to rise; in this way, however, the cleaning unit's ordinary bypass valve (12) will sense that delivery from the pump (P) is totally blocked, whereby it connects the pump in bypass state in the ordinary way through a non-constricted bypass connection (14). In this way, ejection can be interrupted temporarily without any substantial heat accumulation in the circulating water, and another advantage is that the ejection conduit itself is pressure relieved in the situation.

2 Claims, 3 Drawing Figures

Figure 1:
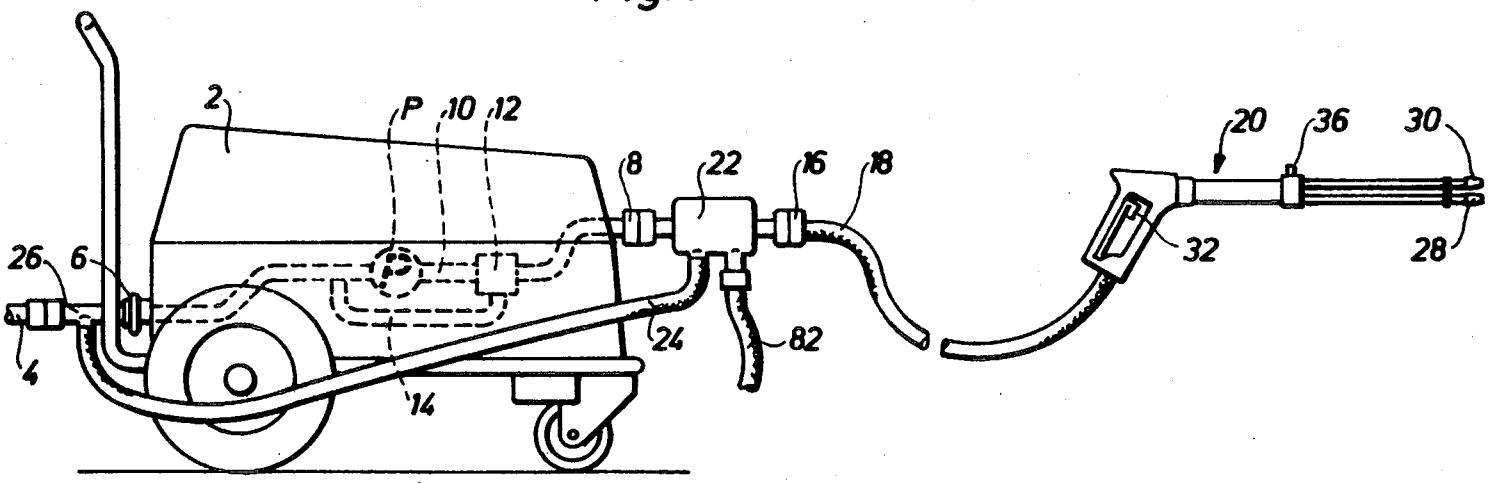

DEVICE IN OR FOR HIGH-PRESSURE CLEANING UNITS FOR HEATING THE WATER BY CIRCULATION

The present invention relates to a device in or for highpressure cleaning units to enable recirculation water to be heated by being pressed through a constricted nozzle area in a return conduit between the inlet and delivery sides of the pump.

Normally, the pump in a high-pressure cleaning unit is a piston pump, i.e. a displacement pump, which is operated at almost uniform rate irrespective of other operating conditions, whereby the pump will deliver practically the same volume flow of water or any other pump medium on the deivery side. The delivery side is connected to an ordinary, hand-held ejection nozzle, which can be brought into three different functional states by means of associated valves, i.e. (1) closed state, (2) open state for ejection through a narrow high-pressure nozzle, and (3) open state for ejection through a wider low-pressure or flushing nozzle. Normally, in the two open states, almost the same volumes of water per time unit will be delviered, but the pressure, and thus the jet force, will depend on the nozzle in operation; when the low-pressure nozzle is connected, it is not absolutely necessary to close the high-pressure nozzle, which will only be largely passive at the now reduced discharge pressure.

When the nozzle is closed, care should of course be taken to ensure that the water delivered from the pump can escape in a suitable way, and the usual way is by means of an incorporated return or bypass connecting with the pump's inlet side, so that the pump simply continues operating in bypass mode when ejection is shut off. In principle, this could easily be controlled by means of a safety valve caused to open to the bypass conduit when the pressure on the inlet side is caused to exceed the normal, high operating pressure, viz. when ejection is closed. In this way, however, the pump should operate against a very high pressure, and the associated necessary effect would become manifest as a vigorous heating of the recirculating water. Upon incipient boiling of the water, the pump will "cavitate", i.e. operate with steam, which of course acts quite differently from liquid in terms of displacement, and upon reopening the ejection nozzle, steam and scalding liquid will flow out. Hence, for several reasons such a control principle for the bypass function is quite unrealistic.

However, already on this basis it is quite commonly recognized that a bypass established through a pressure drop results in heat generation, and of course devices can be used that try to utilize this circumstance to generate any desired, acceptable heating of the water in a controlled way.

However, a high-pressure cleaning unit should be able to continuously operate with cold water, so that any heating device should only be for selective use. In order to avoid the said vigorous heating of water in bypass state, various control devices have been developed, which cause a bypass conduit to open completely when liquid ejection from the nozzle stops, so that the bypass can be established at a quite low pressure on the pump's delivery side. Such devices will not be described in more detail here, it being simply assumed that the high-pressure cleaning unit incorporates such a bypass control device, which removes the high pressure from the ejection conduit when ejection is shut off, whereby the bypass can be established at low pump effect, and thus without any significant heating of the water.

When it is desired to add a device in such a high-pressure cleaning unit for selective, moderate heating of the water, the obvious—and already proposed—measure would be to place a change-over valve on the pump's delivery side, by means of which the water can be caused to flow through either a direct conduit to the ejection nozzle, i.e. for normal cold water operation, or through a conduit section parallel with it, said section being connected by a branch conduit with the pump's inlet side through a suitable constricted passage; when the water is fed to the parallel conduit by means of the change-over valve, the water can in part continue to the ejection nozzle and in part back to the pump's inlet side, whereby it passes the constriction, thus generating heat. When ejection is possible, more or less water will be allowed to flow through the nozzle, depending on the nozzle size used, and the remaining portion of the water flowing from the pump will be recycled while generating heat, so that the apparatus can operate with a continuously resulting heating of the ejected water.

When the discharge is shut off, the pressurized water will only be able to escape through the return conduit, whereby the entire water flow will pass the said constriction under an increased pressure, causing increased heat generation. This is an undesirable effect, because the heat accumulates for as long as no ejection is ongoing, and thus a corresponding amount of a partial current of cold water is supplied to the pump's inlet side. In this way, the temperature of the circulating water may soon reach the boiling point, whereby the pump will start cavitating; this would be a quite unacceptable operating situation for several reasons. In order to avoid this undesirable temperature rise, it has been proposed that a water reservoir be inserted in the return connection to the pump's inlet side, the said reservoir being able to ensure by heat exchange with the surroundings that the accumulating heat is balanced by heat dissipation from the reservoir to the surroundings, whereby the temperature can be kept as low as e.g. 50°–70° C.

However, it goes without saying that the necessary heat exchange with the surroundings reflects a substantial energy loss. As a matter of fact, such a loss can be avoided by the user of the apparatus operating the said change-over valve to select normal operation without heat generation, whereby the described incorporated bypass valve will respond to the closed ejection, i.e. closed discharge from the pump's delivery side, and thus switch the apparatus to ordinary bypass operation without special heating of the water and without use of any major pump effect; however, it is undesirable to prescribe such special operating conditions, as a user will not always know in advance whether a temporary interruption of ejection with connected heating device will be brief or long, as, of course, a short-term interruption will not cause any major temperature increase in the water.

In order to achieve reasonable cost benefits from the known device described here, it will of course be desirable that the mentioned balance temperature be kept as high as possible, precisely because the heat dissipating to the surroundings actually means a loss of energy in the pump. A specially high temperature of the ejected water is however rarely desirable or necessary, and in some cases it may even be extremely undesirable, e.g. where a standard high-pressure cleaning unit is to be used for cleaning domestic animals in view of the associated risk of scalding them.

The object of the invention is to provide a device of the said type, by means of which it can be ensured that when connected, the heating device will not give rise to any disturbing and loss-making heating in the cases where the discharge through the ejection nozzle is temporarily shut off.

The invention is based on the consideration that an immediate cause of the said problem is that the incorporated bypass valve cannot register the closing in question, as long as this is only reflected in the fact that the water delivered from the pump can continue to flow out, namely through the heat-generating return conduit. The pressure will rise slightly when the discharge is shut off, but the bypass valve will continue to register a normal operating condition, so that it will not open for the direct, non-heat-generating bypass. In view of this, the invention proposes the provision of a device incorporating a sensor capable of registering the operating situation that there is no discharge to the nozzle in or from the said parallel conduit, and which, depending on this, may cause the recycling of the water from the pump's delivery side to its inlet side to take place through a conduit without major constrictions, preferably in a simple way by the sensor only causing a block of the special return conduit, whereby the already incorporated bypass valve will register a total interruption of water delivery from the pump's delivery side and thus in a normal way be set to produce a bypass through a non-constricted bypass conduit, permitting bypass of a slight volume of water having limited effect. Heating is reestablished as soon as ejection is reopened, i.e. it can proceed in a highly controlled way without accumulation problems or losses.

In such a device, a concomitant, major advantage will be that the length of hose extending to the ejection nozzle will be pressure-relieved after interruption of discharge, so that reopening the discharge—possibly after stopping the pump motor—provides the safety advantage that high-pressure discharge of water through the ejection nozzle will not be immediately possible from a presumably inactive high-pressure cleaning unit by any unauthorized operation of the ejection valve.

Figure 2:
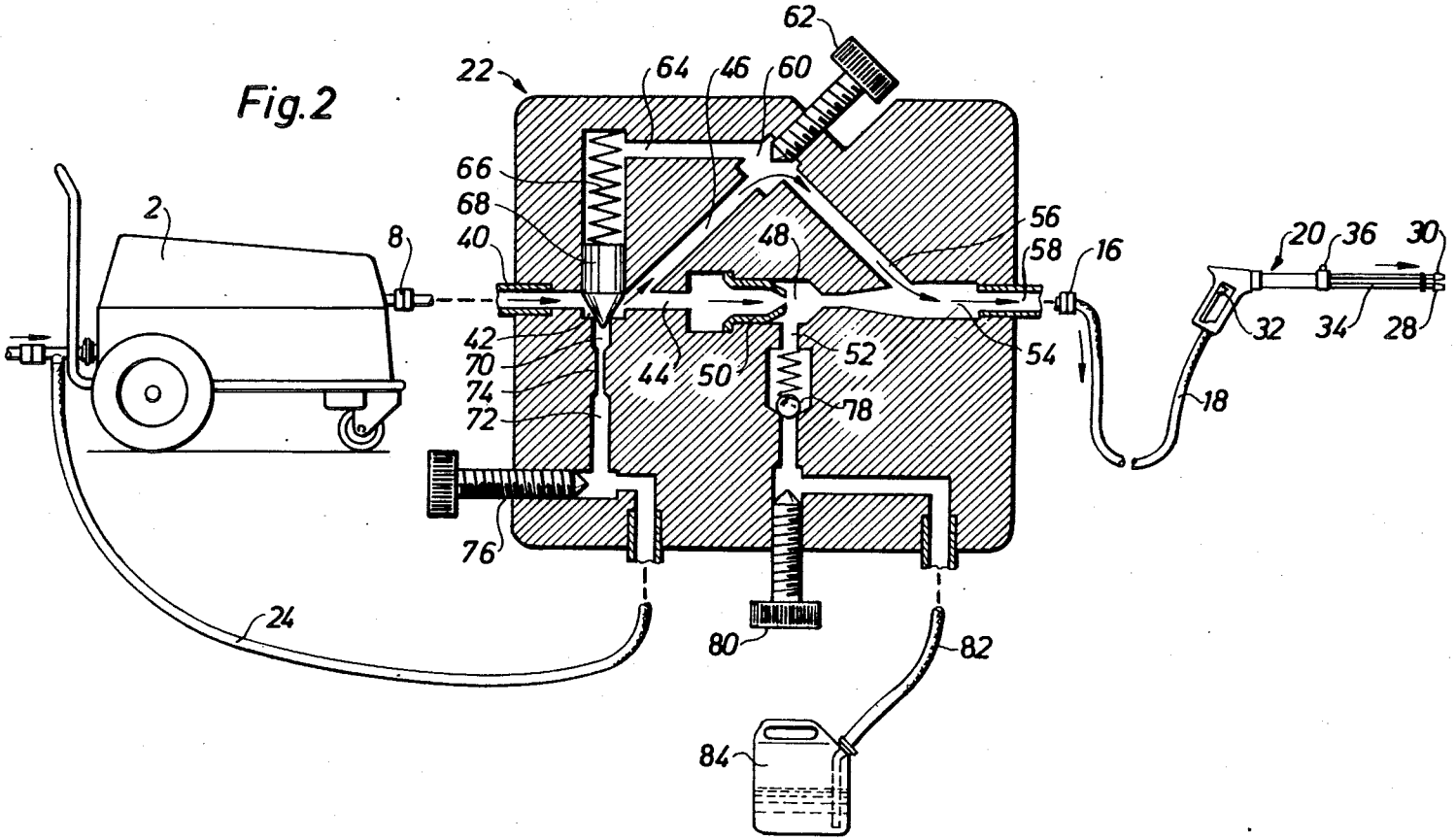
Figure 3:
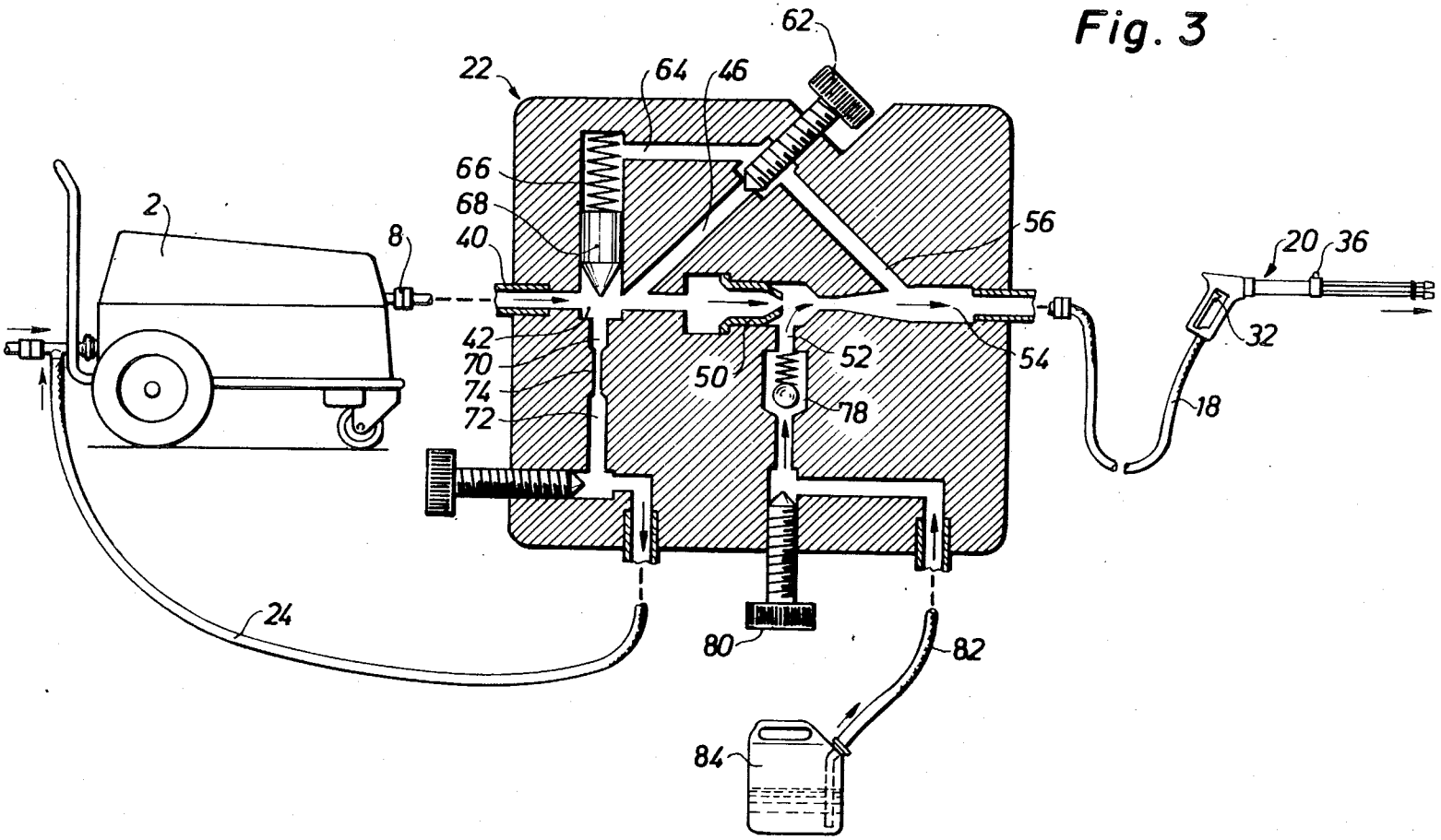

The invention will be explained in more detail below with reference to the drawing, in which FIG. 1 is a side view of a high-pressure cleaning device with an added device according to the invention, while FIG. 2 is a schematic view of this device and FIG. 3 a corresponding view of the device in another operating condition.

FIG. 1 shows a high-pressure cleaning unit 2 with a pump P shown by a dotted line, the inlet side of which pump is connected to an inlet conduit 4 through a quick-connective coupling 6, and whose delivery side is connected to a discharge nozzle 8 through a conduit 10, in which is provided a valve device 12, which connects with the pump's inlet side through a branch conduit 14. The discharge nozzle 8 is a quick-connective coupling, which can accept a coupling part 16 at the end of a spraying hose 18, which leads to a spraying grip 20. It is however shown that a unit 22 is disposed between the parts 8 and 16, said unit 22 being designed with opposite quick-connective coupling parts and otherwise having a branched hose 24, terminating in a quick-connective coupling part 26 in the form of a short transverse pipe section, which can be connected between the quick-connective coupling 6 and the inlet or suction tube 4.

Thus, the high-pressure cleaning unit can operate conventionally by connecting the inlet tube 4 directly to the quick-connective coupling 6 and the spraying hose 18 directly to the discharge nozzle 8. In this way, the incorporated valve device 12 will see to it that full operating pressure is maintained on the pump's delivery side when pressurized water is ejected through the spraying grip 20, shown with two ejection nozzles 28 and 30 and a pistol valve 32 for opening and closing ejection. The nozzle 30 is a comparatively large flushing nozzle, connected in the spraying grip 20 to the hose 18 through a separate pipe 34, in which a shut-off cock 36 is disposed. In operating this cock, the operator may choose whether activating the pistol valve 32 will result in water being ejected at high presure through the nozzle 28, which is a narrow high-pressure nozzle, or—by opening the cock 36—essentially through flushing nozzle 30 at a substantially lower pressure; in the latter case, an insignificant volume of water will of course only be ejected through the narrow nozzle 28.

When closing the pistol valve 32, the valve unit 12 will sense the consequent greatly changed pressure or flow conditions, and in consequence open a connection between the pressure conduit 10 and the bypass conduit 14, such that the pump's delivery side connects directly with its inlet side through conduit 14, whereby the pump can continue idling without causing any appreciable heat accumulation in the small volume of water. When the discharge through spraying grip 20 is reopened, irrespective of whether spraying takes place through the nozzle 28 or the nozzle 30, the unit 22 will register the change of situation and close the bypass conduit 14, so that the pump's delivery side will once more be connected directly and solely to the spraying hose 18.

It should be noted that a well-known procedure is to insert an injector device so arranged in the discharge conduit from the pump that an additive may be injected through it to the water flow discharged. This addition is preferably controlled so as to take place when ejection occurs at a low or medium pressure through the flushing nozzle 30, while the injector device is disconnected when high-pressure ejection is effected through the nozzle 28. This disconnection is desirable, in part because addition of additives is rarely needed in high-pressure operation, and in part becuse per se the operative injector device requires an undesired pressure drop in the delivery hose from the pump, at a time when precisely maximum operating pressure is desired from it.

By adding the external unit 22 with associated external return connection 24, it is attempted to achieve that the discharge water from the pump P can partially return directly to the pump's inlet side through a constricted, heat-generating passage, as long as ejection of the remaining water occurs through the nozzle 28 at low ejection pressure. The nozzle 28 must still be selectably useful for high-pressure ejection without opening the return connection, and the high-pressure cleaning unit must essentially continue to be useful, also in the ordinary way The design of the device 22 inserted in the pressure connection is shown schematically in FIGS. 2 and 3. It includes an inlet conduit 40 connected with the discharge nozzle 8 and extending onwards through a valve passage 42, a pipe part 44 with a branch pipe 46, a nozzle casing 48 incorporating a nozzle 50 and a delivering injection pipe 52 and further on through a converging chamber 54, in which also a side pipe 56 terminates, to a discharge branch 58 connecting with the pressure hose coupling 16.

The branch pipe 46 and the side pipe 56 meet in a valve casing 60 in which is placed a manually operable needle valve 62, by means of which the mouth of the branch pipe 46 in the valve casing 60 can be opened or closed. Further, this casing connects through a conduit 64 with the upper or external end of a cylinder 66, incorporating a spring-loaded valve cone 68, whose cone point protrudes down through the valve passage 42 for closing a seat opening 70 in it, said opening connecting with a side branch 72 comprising a constricted portion 74 and an adjusting valve 76, after which the conduit 72 merges with the return conduit 24 also shown in FIG. 1.

The injection pipe 52 connects with an injector hose 82 through a non-return valve 78 and an adjusting valve 80, cf. also FIG. 1, through which e.g. rinsing liquid for the nozzle casing 48 may be sucked in from a container 84.

In the situation shown in FIG. 2, the upper valve 62 is open, whereby the apparatus can work in the ordinary way. When the pistol valve 32 is open for ejection through one of the nozzles 28 or 30 at high and medium pressure operation, respectively, the pressurized water from the pump will pass the valve passage 42 around the point of the valve cone 68, and a minor portion will from thence flow through the injector nozzle 50 to the converging chamber 54, while the main part of the water will flow more freely through the branch conduit 46, the valve casing 60 and the side conduit 56 to the same chamber 54, from where the water flows out to the ejection nozzle through the hose 18. The pressure on the two sides of the injector nozzle 50 will be almost identical, i.e. the nozzle will be inoperative as injector. The prssure on the two sides or ends of the valve cone 68 will also be essentially identical, as the upwardly extending pressure from or in the valve passage 42 can immediately propagate to the cylinder 66 through the conduits 46 and 64. The spring-loaded valve cone 68 will thus keep the seat opening 70 closed, so that discharge to the return conduit 72,24 is blocked.

When the pistol valve 32 is closed, all flow will stop without the conditions in the unit 22 changing, and the said incorporated bypass valve 12 will cause the water from the pump to bypass through the bypass conduit 14, while a low pressure will be imparted to the entire external system connected with the discharge branch 8.

When it is desirable to operate with water heating, the upper valve 62 is closed, i.e. discharge from the branch conduit 46 is blocked, and then the water can only run through the nozzle 50 when ejection is opened, cf. FIG. 2. In this way, an appreciable pressure drop arises across this pressure-loss-causing nozzle, whereby the pressure in the valve passage 42, and thus on the lower surface of the valve cone 68, will be appreciably larger than the pressure in the converging chamber 54, from where the pressure prevailing there can freely propagate to the top surface of the valve cone 68 through the conduits 56 and 64 and the cylinder 66. The spring pressure on the differential pressure valve cone 68 is so adapted that at this pressure difference the valve cone will move upwards for opening the seat mouth 70 of the return conduit 72,24. The result will then be that part of the water flow is fed through the injector nozzle 50 to the pressure hose 18, while another part of the water flow is pressed through the constriction 74 in the conduit 72 for being returned to the inlet side of the high-pressure pump. The ratio between these flows can for instance be 1:5.

The practical result is that the main part of the pressurized water from the pump is pressed through the constriction 74 in the return conduit 72,24, whereby the return water will be heated, while the remainder of the water flow is fed through the injection nozzle for ejection through the ejection nozzle 20, whereby the nozzle 50 is made operative as an injection nozzle, i.e. additive liquid from the container 84 can be sucked into the ejected water, depending on the opening degree of the valve 80 in the injector conduit 52,82. Hence, the high-pressure cleaning unit will be able to operate with a reduced flow of ejected water, which is kept heated via the recycling of the remaining portion of the water flow through the constriction 74.

When ejection is shut off via the pistol valve 32, the pressure on the two sides of the injector nozzle 50 will be equalized, thus causing the pressure on the top and bottom sides of the valve cone 68 to be equalized, so that the valve cone 68 will then press resiliently against the seat 70, thus blocking the return flow of water through the conduit 72,24. In this way, all discharge from the discharge side of the high-pressure pump P is stopped, and the incorporated bypass valve 12 (FIG. 1) will then see to it that the water is bypassed while a quite low pressure is maintained on the pump's discharge side. This low pressure can propagate to the pressure hose 18 through the injector nozzle 50, so that also the pressure hose, and thus the ejection nozzle, is pressure relieved.

When reopening the pistol valve 32, a low discharge is established, which however causes an appreciable pressure drop across the nozzle 50; in this way, the valve cone 68 is pressed upwards, thus opening for the seat 70, the result being that intensified total discharge can take place from the pump. This discharge is sufficient to shut off the incorporated bypass valve 12, whereby the operating state "reduced ejected water flow with continuous heating" will be re-established when the upper valve 62 continues to be kept closed. If this valve has been opened in the meantime, the work will be resumed under quite ordinary operating conditions for work with cold high or medium pressure water, as in that case the valve cone 68 will keep the heat-generating return conduit 72,24 closed. It will be seen that the nozzle 50 has several different functions, viz. in part to act as an injector nozzle for additive—at operation with reduced ejection water flow and at water heating, and in part to act as a sensor registering ejection when the valve 62 is closed, as in that case the nozzle will cause such a pressure difference between the top and bottom surfaces of the valve cone 68 that it opens for the return flow through the seat 70. For the primarily considered effect it is essentially insignificant that—or whether—the nozzle 50 is additionally utilized as injector nozzle, as an additive may be added in another way, if required, also upon cold water flushing with the valve 62 open.

In addition, the nozzle 50 serves the significant object of contributing to determining the ratio between the water flows in the return conduit 72 and the spraying hose 18, respectively, when the heating device is activated.

In principle, the nozzle's sensor function can be exercised by any suitable flow sensor device, which may cause opening of the return flow through the constriction 74, e.g. by operating a solenoid valve provided in the conduit 72, when free flow around the sensor 50 is closed via the main valve 62, or when this might have been rendered inoperative in any other way with respect to opening for the said return flow. However, it should be noted that the desired water heating does not justify any particularly complex or costly device, as the desired result can then be achieved more appropriately by using e.g. an electrical flow heater.

However, the crucial aspect of the invention continues to be that upon temporarily ceasing flushing operation in the situation in which the heating device is connected (with the valve 62 closed), the return conduit 72,24 will be blocked, so that heat generation ceases by the ordinary, incorporated bypass valve being activated. In principle, the device 22 could be connected with an additional, non-constricted return conduit, whereby a changeover bypassing the constriction 74 to the extra return conduit could be achieved instead of the simple blocking of the return conduit 70, but certain associated complications make it more attractive to make do with utilizing the already existing, incorporated bypass valve.

In the invention, the pump's delivery side is permanently open to both the main flow 46,56 and the parallel conduit 44, in which the nozzle 50 is placed, and the return conduit 72 branches directly from the main discharge conduit 40 from the pump's delivery side.

It should be noted that also in the ordinary bypass through the incorporated bypass valve, the water will be heated to a certain extent; the water will thus reach a fairly high temperature. The essential aspect, however, is that the circulating water volume here is small, and that upon reopening ejection, cold feed water will immediately be fed to the pump, whereby any high temperature of the circulating water will not have time to propagate to the ejected water.

I claim:

1. High-pressure cleaning apparatus having two operating modes comprising:

an ejection nozzle for discharging fluid;

a high-pressure pump having delivery and suction sides;

a return conduit between said delivery and suction sides of said pump and having a constricted portion for generating heat during the passage of fluid therethrough;

a non-constricted bypass connection between said delivery and suction sides of said pump;

a bypass valve responsive to a total interruption of water delivery from said delivery side of said pump for producing a bypass through sid non-constricted bypass connection;

conduit means, including a shut-off valve, for communicating with said delivery side of said pump and with said ejection nozzle when said shut-off valve is open, thereby setting the apparatus in a first operating mode;

means responsive to pressure in said conduit means for blocking any return flow through said constricted conduit portion when any discharge of fluid through said ejection nozzle is blocked when the apparatus is in said first operating mode, said pressure-responsive means comprising a differential pressure valve for feeding fluid downstream from said delivery side of said pump when said apparatus is in a second operating mode; and a pressure-loss-causing nozzle coupled to said differential pressure valve;

said shut-off valve being effective, when closed and thereby setting the apparatus in said second operating mode, to close said conduit means, causing discharge fluid to flow through said pressure-loss-causing nozzle when said ejection nozzle is open;

said blocking means being responsive to the pressure differential across said pressure-loss-causing nozzle for unblocking return flow through said constricted portion of said return conduit for heating the fluid flowing therethrough when the apparatus is in said second operating mode;

said blocking means being effective to block return flow through said constricted portion of said return conduit when said ejection nozzle is closed when the apparatus is in said second operating mode.

2. Apparatus according to claim 1, in which said pressure-loss-causing nozzle communicates between said delivery side of said pump and said ejection nozzle and in which said conduit means includes a shunt connection around said pressure-loss-causing nozzle, said shunt connection including said shut-off valve.

* * * * *

UNITED STATES PATENT AND TRADEMARK OFFICE

CERTIFICATE OF CORRECTION

PATENT NO. : 4,687,138

DATED : August 18, 1987

INVENTOR(S) : Tage V. Østergaard

It is certified that error appears in the above-identified patent and that said Letters Patent is hereby corrected as shown below:

Column 4, line 48 for "becuse" read -- because --

Column 8, line 7 for "sid" read -- said --

Signed and Sealed this

Thirteenth Day of June, 1989

*Attest:*

*Attesting Officer*

DONALD J. QUIGG

*Commissioner of Patents and Trademarks*